US005695379A

United States Patent [19]

Ho

[11] Patent Number: 5,695,379

[45] Date of Patent: Dec. 9, 1997

[54] BUBBLE PRODUCING TOY

[75] Inventor: Yat-Ming Ho, Tsing Yi Island, Hong Kong

[73] Assignee: Well Skill Industrial Ltd., Hong Kong, Hong Kong

[21] Appl. No.: 565,315

[22] Filed: Nov. 30, 1995

Related U.S. Application Data

[63] Continuation of Ser. No. 294,647, Aug. 23, 1994, abandoned.

[51] Int. Cl.[6] ..... A63H 33/28

[52] U.S. Cl. ..... 446/15; 446/20

[58] Field of Search ..... 446/15–21

[56] References Cited

U.S. PATENT DOCUMENTS

| | | | |
|---|---|---|---|
| 2,398,513 | 4/1946 | Bradley | 446/15 |
| 2,720,723 | 10/1955 | Peretti | 446/15 |
| 2,794,292 | 6/1957 | Noble | 446/16 |
| 3,002,314 | 10/1961 | Brottman . | |
| 3,295,248 | 1/1967 | Knerr et al. | 446/15 |
| 3,323,250 | 6/1967 | Gibbons | 446/15 |
| 3,579,898 | 5/1971 | Hein | 446/16 |
| 3,745,693 | 7/1973 | La Fata et al. | 446/15 |
| 4,128,962 | 12/1978 | Anderson | 446/15 |
| 4,152,864 | 5/1979 | Habisohn | 446/15 |
| 4,411,095 | 10/1983 | Rushing et al. | 446/20 |
| 4,919,417 | 4/1990 | Poulas . | |
| 5,035,665 | 7/1991 | Shing | 446/15 |
| 5,102,381 | 4/1992 | Danielak et al. | 446/15 |
| 5,224,893 | 7/1993 | Routzong et al. | 446/15 |

*Primary Examiner*—Robert A. Hafer
*Assistant Examiner*—Jeffrey D. Carlson
*Attorney, Agent, or Firm*—Burns, Doane, Swecker & Mathis

[57] ABSTRACT

A hand-held bubble producing device comprising a handle and bubble generating means capable of producing different sizes of bubbles when being swung around through the air or being blown against. Apart from producing bubbles, the bubble generating means can also appear in a number of decorative shapes.

4 Claims, 3 Drawing Sheets

BUBBLE PRODUCING TOY

This application is a continuation of application Ser. No. 08/294,647, filed Aug. 23, 1994 abandoned.

FIELD OF THE INVENTION

This invention relates to bubble-producing devices, and in particular, to a simple toy capable of producing bubbles of various sizes when being swung around through the air or being blown against.

BACKGROUND OF INVENTION AND PRIOR ARTS

Children enjoy playing with bubbles and there are many varieties of bubble producing toys suggested and produced. Perhaps the simplest type comprises a stick with a circular port at one end. A film is formed when the port is dipped in a bubble producing liquid and then retrieved. Bubbles are then formed by blowing carefully against the film. Such a toy requires dipping everytime and a separable bottle of easily bubble forming liquid must be carried around.

U.S. Pat. No. 5,102,381 discloses a jump rope which produces bubbles when the bubble producing parts are being swirled through the air. The bubble producing method described in this patent suffers many drawbacks. Firstly, only bubbles of the size comparable to the size of the bubble-producing openings are produced. Secondly, bubbles are produced by firstly forming a film on the openings distributed on the curved surface of a cylindrical bubble producing part which are swirled through the air. As only a small portion of the curved surface are subject to the direct impact of air current resulting from motion or natural draught, only a small portion of the films formed are successfully converted into bubbles, the remaining majority of the films become mere waste drippage. Thirdly, the bubble producing part comprises two concentric cylinders with a gap in-between for distributing bubble forming liquid from the reservoir to the openings. The diameter of the cylindrical part must be sufficiently large to provide a reasonable windward surface for bubble production which means that a considerable amount of bubble forming solution is required initially just to spread across the whole cylindrical spacing-gap in order to form films across the openings, while only a small portion of the film eventually becomes bubbles. Finally, production of bubbles by swirling in circular motions of the bubble producing parts causes vacuum formation in the reservoir part, thereby preventing further transportation of bubble forming solution to the bubble producing parts.

SUMMARY OF THE INVENTION

It is therefore an object of the present invention to provide a simple re-fillable bubble-producing toy which is capable of producing bubbles of different sizes while at the same time reducing liquid drippage by a secondary bubble producing means which maximally utilises the bubble producing liquid which would otherwise have been wasted. Utilization of the bubble producing fluid is further enhanced by a tertiary bubble producing means.

According to the present invention there is therefore provided an improved bubble producing device comprising a first bubble producing means, said first bubble producing means being substantially planar and comprising two members defining a gap therebetween, each of the said members having a plurality of openings therein and the openings in one of said members overlying the corresponding openings in the other of said members, a second bubble producing means, said second bubble producing means surrounding a perimeter portion of the said first bubble producing means, and a liquid reservoir adapted to supply in use liquid to the gap defined between the members in a direction substantially parallel to the surface of said members.

According to the present invention there is also provided an improved bubble producing device comprising a first bubble producing means, said first bubble producing means being substantially concave and comprising two members defining a gap therebetween, each of the said members having a plurality of openings therein and the openings in one of said members overlying the corresponding openings in the other of said members, a second bubble producing means, said second bubble producing means surrounding a perimeter portion of the said first bubble producing means, and a liquid reservoir adapted to supply in use liquid to the gap defined between the members in a direction substantially parallel to the surface of said members.

According to the present invention there is further provided all improved bubble producing device comprising a first bubble producing means, said first bubble producing means being substantially convex and comprising two members defining a gap therebetween, each of the said members having a plurality of openings therein and the openings in one of said members overlying corresponding openings in the other of said members, a second bubble producing means, said second bubble producing means surrounding a perimeter portion of the said first bubble producing means, and a liquid reservoir adapted to supply in use liquid to the gap defined between the members in a direction substantively parallel to the surface of said members.

Preferably the aforementioned second bubble producing means comprising a plurality of ribs and meshes.

DETAILED DESCRIPTION OF THE DRAWINGS

Two embodiments of the present invention will now be described by way of example and with reference to the accompanying drawings in which.

DETAILED DESCRIPTION OF THE PREFERRED EMBODIMENTS

Figure 1:
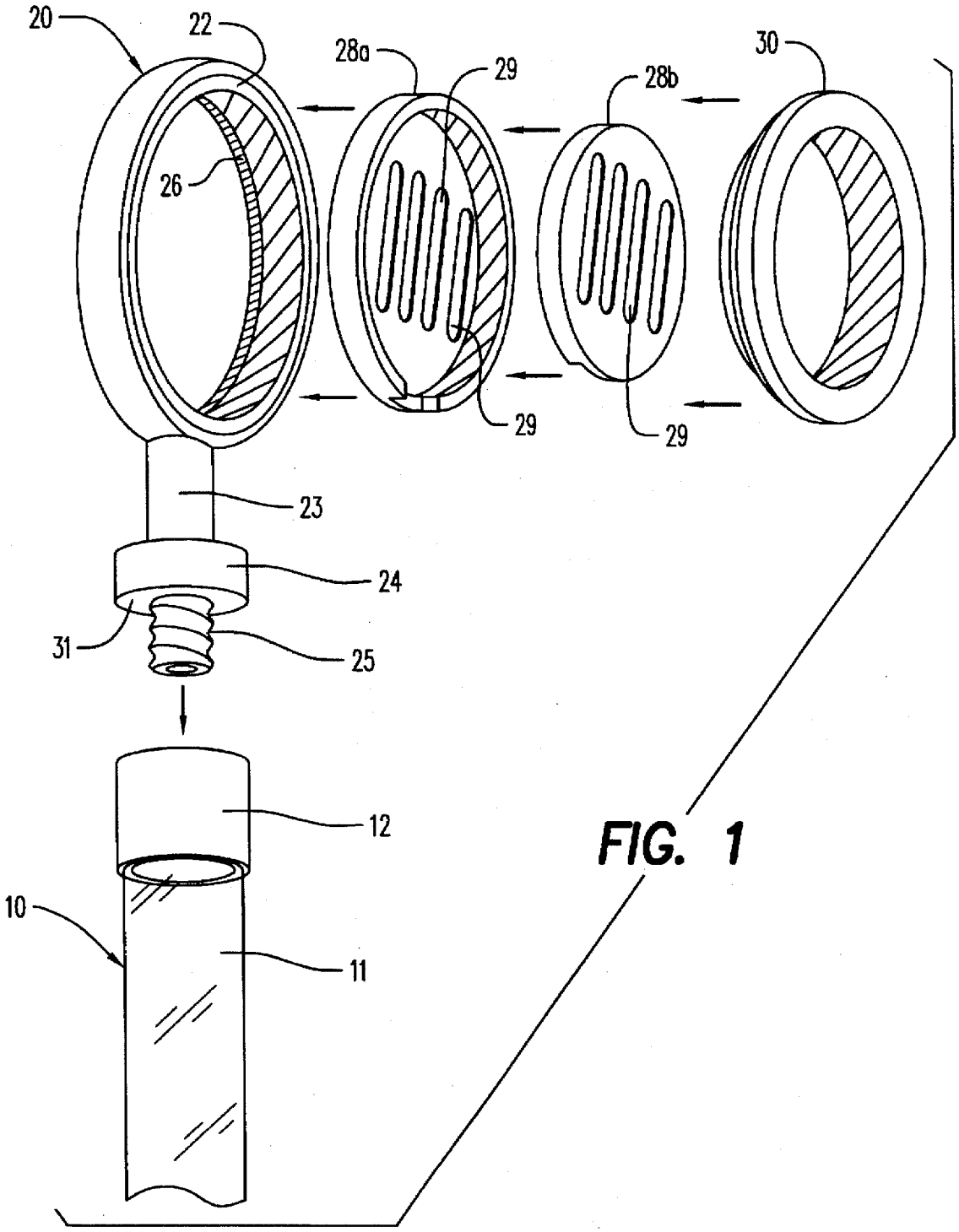
FIG. 1 shows the perspective view of the first embodiment with parts taken apart.

Referring to FIG. 1 there is shown a first embodiment of the present embodiment in the form of bubble producing device comprising a handle 10 and a detachable head portion 20.

The handle 10 comprises a rigid or semi-rigid elongated tubular housing sealed at one end to provide a reservoir 11 for bubble forming liquid storage. There is provided a shoulder-cap 12 on the other end of the handle for reinforcing the opening. There are also provided threads in the inner surface of the shoulder-cap for coupling with the head portion 20. The handle 10 is made preferably of a transparent plastic material so that liquid level inside the reservoir 11 can easily be monitored.

The head portion 20 comprises a mounting-frame 22, a neck 23, a collar 24 and a coupling means 25. The mounting-frame 22 comprises a receptacle 26 capable of tightly accommodating a bubble-plate 28, said bubble-plate 28 comprises two interlocking planar plate-members 28*a* and 28*b* having a plurality of openings 29 therein and said member being so disposed that the openings in one of the said members overlie corresponding openings in the other of said members, a narrow gap being defined between said members, forming a slit-channel and communicating said openings 29 with said reservoir 11 of the handle. To secure the bubble-plate 28 onto the frame receptacle 26, there is provided a push-fit cap 30 which is complementary to the mounting-frame 22 after the bubble-plate 28 has been properly put into position.

The collar 24 comprises a hollow stem which extends from bottom of tile coupling means 25 through to the mounting frame 22. When the bubble-plate 28 has been properly fitted into the mounting frame 22, the slit-channel inside the bubble-plate 28 is communicable with the hollow stem inside the neck 23, thereby allowing liquid to move from the reservoir 11 to the plate-members 28*a* & 28*b*.

To operate the device, the reservoir 11 is firstly filled with bubble producing liquid, the head portion 10 is attached and secured onto the handle 20 by tightening screw threads on the outside of the coupling means with the corresponding complementary threads on the inner surface of the shoulder-cap 12 of the handle 10. Naturally, the head portion 20 can also be secured onto the handle 10 by a push-fit, clipping, friction or other means. When the head portion 20 is properly attached onto the handle 10, the lower edge 31 of the collar should be in contiguous contact with the upper edge of the shoulder-cap 12 of the handle 10, thereby forming a leakage seal at the junction 32 (see FIGS. 3 and 4).

When the handle 10 is shaken, swung or swirled through the air, the bubble producing liquid contained therein is set into forced movements and travels inside and along the handle 10. Some of the liquid is transported through the hollow stem inside the coupling means 25 to the collar portion 24, then to the slit-channel inside the bubble-plate 28 and eventually to the plate-members 28*a* & 28*b*. The liquid which encounters the plate-openings 29 spreads across the openings 29 and forms films thereon. The films so formed subsequently becomes bubbles when blown against either by a user or by air.

The primary form of bubbles formed are directly from films formed on the openings 29 on the bubble-plate 28 and are therefore dependent on the shapes and sizes thereof. Various shapes of openings such as elliptical, circular or oblong have been tried and proved to be satisfactory.

While a planar bubble-plate 28 has been described in the present embodiment, it would be obvious to persons skilled in the art that concave or convex bubble-plates providing a substantial windward air-resistant surface may also be used, albeit with lesser bubble producing efficiency.

In the present embodiment, the bubble-plates are described as comprising two members, however, it can also be formed as an integral unit, e.g. by moulding, welding, gluing or otherwise, with see-through openings on either sides of the bubble plate while maintaining a gap in-between.

With the present embodiment, there is therefore provided a simple bubble producing toy which is capable of producing bubbles of various shapes, sizes and combination thereof. At the same time, liquid which would otherwise have been waste drippage is retained for further bubble formation.

Figure 3:
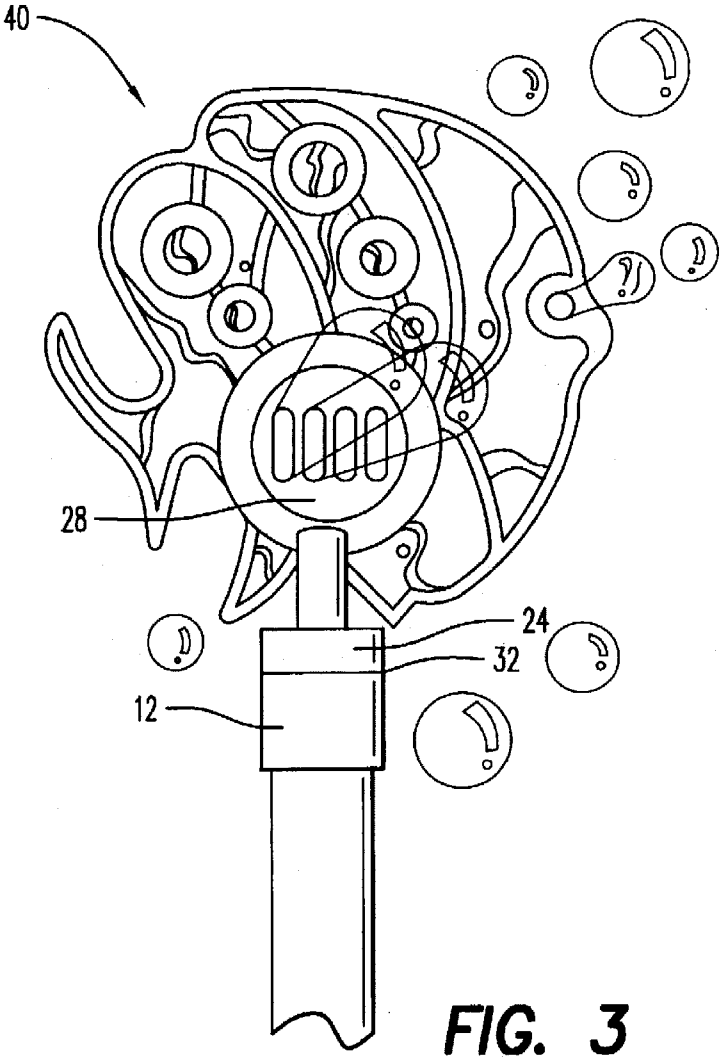
FIG. 3 shows the side view of the second embodiment with the head portion attached to the handle and showing bubbles emerging from the bubble-gate and the meshes.
Figure 2:
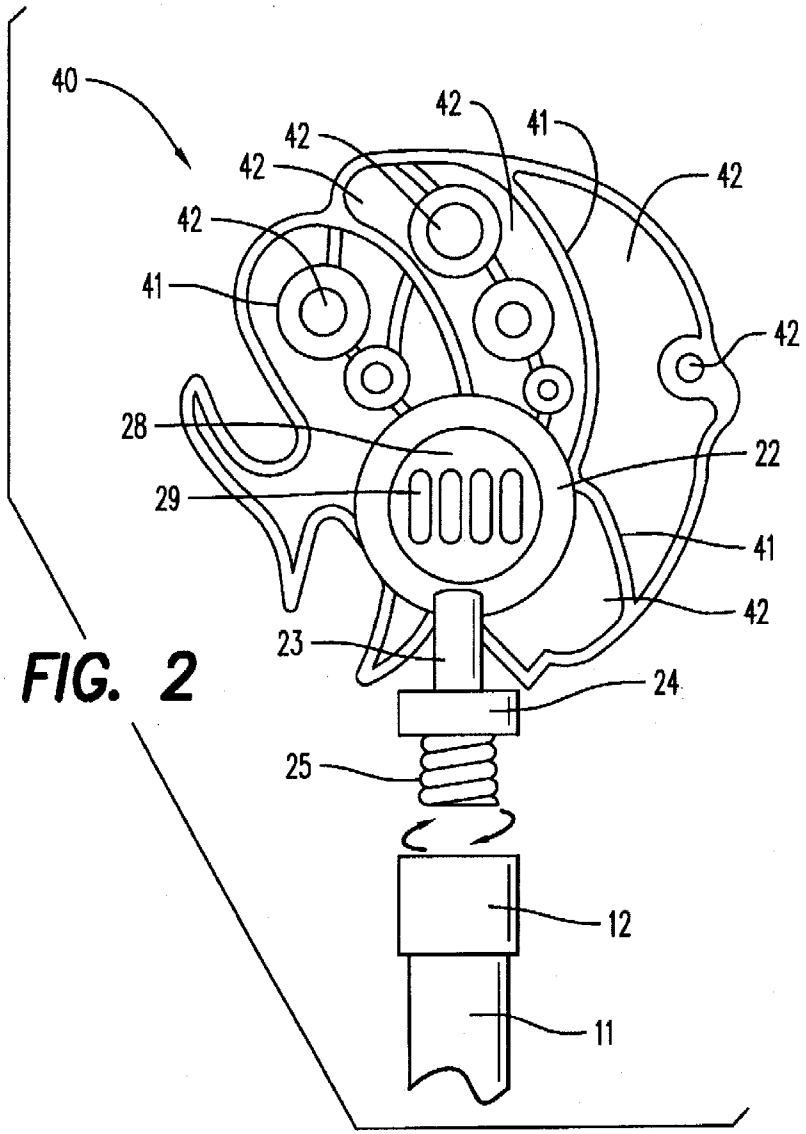
FIG. 2 shows the side view of the second embodiment with the head portion removed from the handle.
Figure 4:
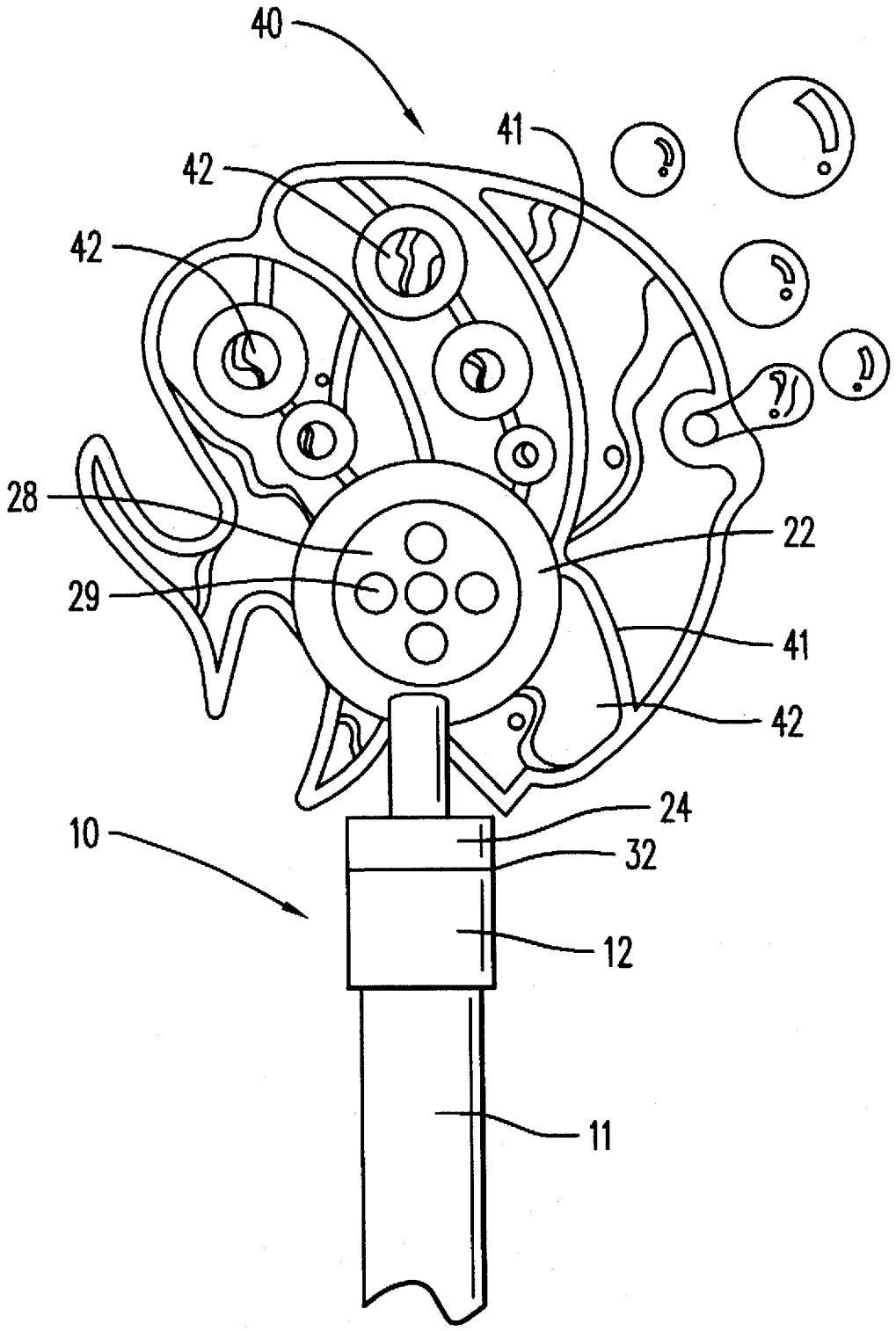
FIG. 4 shows the second embodiment with circular openings on the bubble-gate.

In a second preferred embodiment of the present invention and referring to FIGS. 2 to 4, there is provided a bubble producing device comprising a handle 10 and a detachable head portion 20. The handle is the same as that described in the first embodiment. Apart from the mounting frame 22, the neck 23, the collar 24 and the coupling means 25 described in the first embodiment, the detachable head portion 20 further comprises a second bubble producing means 40, said second bubble producing means 40 being formed above the coupling means 25 and encompassing the aforementioned bubble-plate 28. The said second bubble producing means 40 is made preferably of the same material as the rest of the head portion 20 such that the mounting frame 22, the receptacle 26, the neck 23, the collar 24 and the coupling means 25 can be moulded as one integral unit. The said second bubble producing means 40 can be in the form of a planar decorative figure, such as a bird, a fish, a butterfly or a simple circular plate for instance. Preferably the decorative figure comprises a skeleton with ribs 41, forming a plurality of meshes 42 of different shapes or configurations thereon. When residual liquid is spread onto the tertiary bubble producing means, films of liquid are then formed on the meshes 42. The meshes 42 and the combination thereof becomes bubble forming centres and when the second bubble producing means are blown against, a combination of bubbles of different sizes and shapes are produced.

While the present embodiment has been described with a planar two-dimensional second bubble producing means, it will be appreciated that a three-dimensional mesh-like tertiary second bubble producing means will be equally effective.

With this arrangement, higher yield of bubbles even compared to the first embodiment can be achieved as liquid which would otherwise have been wasted after failing to form bubbles on their first encounters with the bubble-plate, the mounting-frame could still spread across the meshes, thereby forming bubbles.

What is claimed is:

1. An improved bubble producing device comprising:

a first bubble producing means, said first bubble producing means comprising two substantially planar members defining a gap therebetween, each of said members having a plurality of openings therein and the openings in one of said members overlying the corresponding openings in the other of said members, a second bubble producing means, said second bubble producing means comprising a plurality of ribs that are substantially coplanar with said members of said first bubble producing means and enclose at least a portion of the perimeter of said first bubble producing means, and a liquid reservoir connected to the members of said first bubble producing means so as to supply in use liquid to the gap defined between the members in a direction substantially parallel to the surface of said members.

2. An improved bubble producing means according to claim 1, wherein:

the reservoir is inside an elongated handle.

3. An improved bubble producing means according to claim 2, wherein:

the handle and the first bubble producing means are detachable.

4. A bubble producing toy, comprising: an elongated handle, said handle being hollow so as to define a reservoir for bubble producing liquid, and a head portion fitted at one end of said elongated handle, wherein said head portion comprises first bubble producing means comprising two members defining a gap therebetween, each of said members having a plurality of openings therein and the openings in one of said members overlying corresponding openings in the other of said members, said liquid reservoir being in communication with said gap, a frame member surrounding a perimeter portion of said first bubble producing means, and a plurality of ribs interconnected to form a desired pattern and extending outwardly from said frame member to define second bubble producing means.

* * * * *